United States Patent [19]

Stangeland

[11] 4,373,919

[45] Feb. 15, 1983

[54] MULTI-PASSAGE VARIABLE DIFFUSER INLET

[75] Inventor: Maynard L. Stangeland, Thousand Oaks, Calif.

[73] Assignee: Rockwell International Corporation, El Segundo, Calif.

[21] Appl. No.: 207,116

[22] Filed: Nov. 17, 1980

[51] Int. Cl.[3] ..... B63H 11/04

[52] U.S. Cl. ..... 440/47; 60/221; 137/15.1; 440/46

[58] Field of Search ..... 137/15.1, 15.2; 60/221, 60/222; 114/151; 244/53 B; 440/38–47

[56] References Cited

U.S. PATENT DOCUMENTS

| | | | |
|---|---|---|---|
| 3,279,414 | 10/1966 | Rabald | 440/46 |
| 3,286,641 | 11/1966 | Delao | 60/221 |
| 3,343,368 | 9/1967 | Castoldi | 440/46 |
| 3,430,640 | 3/1969 | Lennard | 137/15.1 |
| 3,942,463 | 3/1976 | Johnson | 440/47 |
| 4,027,617 | 6/1977 | Ikeda | 440/46 |

*Primary Examiner*—Trygve M. Blix
*Assistant Examiner*—D. W. Keen
*Attorney, Agent, or Firm*—H. Fredrick Hamann; Harry B. Field

[57] ABSTRACT

A variable inlet for a marine jet propulsion system comprising a movable lip, a center splitter serving to divide said inlet into upper and lower passages and coupled for movement proportional to that of said lip to assure equality of the areas of said upper and lower passages, and apparatus for varying the outward projection of said splitter to vary the diffusion ratio of said upper and lower passages.

4 Claims, 2 Drawing Figures

MULTI-PASSAGE VARIABLE DIFFUSER INLET

BACKGROUND OF THE INVENTION

1. Field of the Invention

This invention relates to marine jet propulsion units, and is particularly directed to a variable area inlet for waterjet propulsors.

2. Description of the Prior Art

It has long been known that the dimensions of the inlet have a substantial effect on the efficiency of waterjet propulsors which varies as a function of the boat speed. To accommodate this effect, it has been suggested to provide means to vary the inlet area so that it could be made smaller, as the boat speed increases. Typically, this is accomplished by providing a lip on the inlet which is movable between an extended portion, supplying low velocity water to the pump at low boat speeds, and a retracted position supplying high velocity water to the pump for high boat speeds. This inverse variation of inlet area to boat speed is necessary because the pump flow rate and velocity remain substantially constant, while the relative inlet velocity of the water varies with boat speed. Unfortunately, the variable inlets of the prior art have had limited diffusion range and have required relatively long axial length in which to achieve diffusion, which decreases the useful space within the boat.

SUMMARY OF THE INVENTION

These disadvantages of the prior art are overcome with the present invention and a variable inlet is provided which also serves to vary the diffusion area ratio over a substantial range of boat speeds.

The advantages of the present invention are preferably attained by providing a variable diffuser inlet having a movable lip and a movable center splitter which serves to divide the inlet into upper and lower passages and which is coupled for movement proportional to that of said lip to assure equality of the areas and diffusion of said upper and lower passages, together with means for varying the outward projection of said center splitter to recover the water relative inlet velocity in said upper and lower passages.

Accordingly, it is an object of the present invention to provide improved inlet means for waterjets.

Another object of the present invention is to provide variable inlet means for varying the diffusion ratio of said inlet means.

A specific object of the present invention is to provide variable inlet means comprising a movable lip, a center splitter serving to divide said inlet into upper and lower passages and coupled for movement proportional to that of said lip to assure equality of the areas and diffusion of said upper and lower passages, and means for varying the outward projection of said center splitter to capture and recover the water inlet velocity evenly in said upper and lower passages.

These and other objects and features of the present invention will be apparent from the following detailed description taken with reference to the accompanying drawings.

DESCRIPTION OF THE PREFERRED EMBODIMENTS

Figures 1, 2:
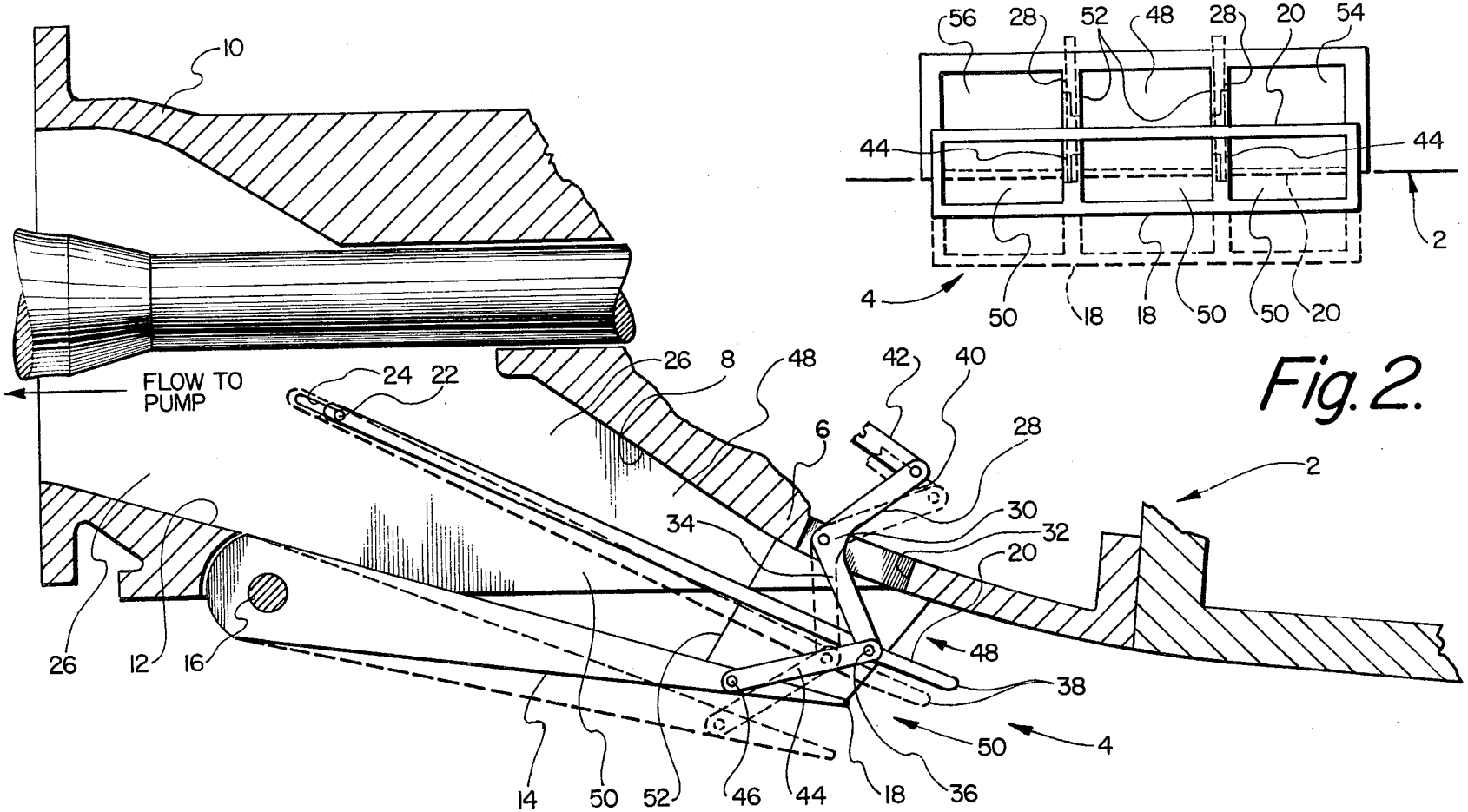
FIG. 1 is a vertical cross-section parallel to the stream lines of a waterjet inlet embodying the present invention.
FIG. 2 is a transverse cross-section of the inlet of FIG. 1, normal to the stream lines of the waterjet inlet embodying the present invention.

In that form of the present invention chosen for purposes of illustration, FIG. 1 shows a portion of a boat hull, indicated generally at 2, having an inlet 4 for supplying water to a waterjet propulsion (not shown). The inlet 4 comprises an upper wall 6 which merges, at its forward end, with the bottom of the boat hull 2 and inclines rearwardly inward to define a diffuse portion 8 terminating in a conduit 10 which leads to the waterjet propulsor. The lower wall 12 of the inlet 4 is provided with a lip member 14 which is pivoted to the lower wall 12, as seen at 16, and tapers forwardly to a relatively sharp leading edge 18. A splitter member 20 projects substantially parallel to the lip member 14 and is formed with a slot 22 adjacent its aft end with a pin 24 projecting through the slot 22 to mount the splitter 20 to the side wall 26 of inlet 4. A rocker 28 is pivoted at 30 adjacent a slot 32 formed in the upper wall 6 of inlet 4. One arm 34 of rocker 28 is pivotally secured at 36 adjacent the leading edge 38 of the splitter 20, while the other arm 40 of rocker 28 is connected to suitable actuating means, such as control rod 42. A link 44 couples point 36 of the splitter 20 with a point 46 adjacent the leading edge 18 of lip member 14. The link 44 forms a scissor linkage with arm 34 of rocker 28 which serves to drive lip member 14 and splitter 20 in a manner such that the movement of lip member 14 is always twice that of splitter 20. Slot 22 cooperates with rocker 28 and link 44 to cause the splitter 20 to project outwardly and retract inwardly in an appropriate manner as the splitter 20 is moved upward and downward to maintain the proper diffusion ratio for the corresponding boat speed.

The splitter 20 serves to divide the inlet 4 into an upper passage 48 and a lower passage 50. As seen in FIG. 2, two sets of links 44 and rockers 28 are provided, spaced athwartwise of the hull 4 and housing 52 surrounds each of the rockers 28 and links 44 and serve to protect these mechanisms and to function as vertical splitters to divide upper passage 48 into a starboard upper passage 54 and port upper passage 56, and to divide lower passage 50 into a starboard lower passage 58 and a port lower passage 60.

As waterjet propelled craft speeds increase, the ratio of maximum craft velocity to pump inlet velocity increases greatly. This velocity increase at high craft speed requires that the inlet area decrease since the pump flow rate and velocity remain virtually constant. Therefore, at high craft speeds, a relatively high area ratio inlet (outlet area/inlet area) is required to match the pump inlet area. Since at high craft speeds the diffuser area ratio is large, a conventional diffuser with a seven-degree or less included angle is very long.

The principles of diffuser design are taught by Johnston and Kline in "Performance and Design of Straight Two-Dimensional Diffusers" ASME Journal of Basic Engineering, March 1967, and the reference included in their report.

Waterjet inlet recovery is at maximum when the ratio of inlet throat velocity to craft velocity is approximately 0.8 in accordance with information presented in Hydronautics Co. Technical Reports 7078-1, 7152-1, 7244-1 and 7244-2. With this information we may look at a typical inlet design for an eighty-knot craft. The diffuser length is noted by N, diffuser inlet width by $W_1$ and the diffuser equivalent included cone angle by ($2\theta$).

Pump Inlet Velocity = 30 fps

Craft Velocity 80 Knots = 135 fps = Vo

Inlet Throat Velocity Optional 0.8 × Vo = 108 fps

Max Area Ratio = 108/30 = 3.6

| | $2\theta$ Diffuser Criteria | | |
|---|---|---|---|
| Area Ratio | Min $N/W_1$ | Max $2\theta$ | $V_{craft}$ |
| 3.6 | 70 | 1.8 | 135 |
| 3.0 | 40 | 3.0 | 112 |
| 2.5 | 16 | 6.0 | 94 |
| 2.0 | 5 | 12.0 | 75 |
| 1.5 | 1.5 | 20.0 | 56 |
| 1.0 | 0 | — | 37.5 |

Per Johnston and Kline ASME Journal of Basic Engineering, "Performance and Design of Straight Two-Dimensional Diffusers", March 1967.

I claim:

1. An inlet for a marine jet propulsion system comprising:

a lip member having one end thereof pivotally connected to the hull of a vessel;

a center splitter serving to divide said inlet into upper and lower passages;

positioning means for moving said splitter in a manner proportional to the movement of said lip to assure equality of the areas and diffusion of said upper and lower passages; and means for varying the outward projection of said splitter to vary the inlet velocity recovery of said upper and lower passages.

2. An inlet for a marine jet propulsion system comprising:

a lip member having one end thereof pivotally connected to the hull of a vessel;

a center splitter serving to divide said inlet into upper and lower passages;

positioning means comprising a rocker arm and scissors linkage for moving said splitter in a manner proportional to the movement of said lip to assure equality of the areas and diffusion of said upper and lower passages; and means for varying the outward projection of said splitter to vary the inlet velocity recovery of said upper and lower passages.

3. The inlet of claim 1 or 2 wherein the last-named means comprises a longitudinal slot formed in the inboard end of said splitter, and a pin extending through said slot to secure said splitter to said vessel.

4. The inlet of claim 1 or 2 further comprising vertical splitter means extending across said inlet serving to laterally divide said inlet and housing said positioning means.

* * * * *